US006675959B1

(12) United States Patent
Chiang

(10) Patent No.: US 6,675,959 B1
(45) Date of Patent: Jan. 13, 2004

(54) PACKAGING CASE

(76) Inventor: Herman Chiang, 11F-2, No 634-9, Ching-Ping Rd., Chung-Ho City, Taipei Hsien (TW)

( * ) Notice: Subject to any disclaimer, the term of this patent is extended or adjusted under 35 U.S.C. 154(b) by 0 days.

(21) Appl. No.: 10/199,381

(22) Filed: Jul. 18, 2002

(51) Int. Cl.[7] ..... A45C 11/04
(52) U.S. Cl. ..... 206/6; 220/4.22; 220/326
(58) Field of Search ..... 206/5, 6; 49/382, 49/386, 394, 395; 16/319, 321; 220/4.21, 4.22, 4.23, 326

(56) References Cited

U.S. PATENT DOCUMENTS 6,039,174 A * 3/2000 Rogers ..... 206/6
6,105,809 A * 8/2000 Yamanaka ..... 220/326
6,398,017 B1 * 6/2002 Cafiero ..... 206/6
6,547,066 B2 * 4/2003 Koch ..... 206/308.1

* cited by examiner

*Primary Examiner*—Luan K. Bui
(74) *Attorney, Agent, or Firm*—Pro-Techtor International Services

(57) ABSTRACT

A packaging case includes an upper casing, a lower casing, and a hinge device for linking the upper casing with the lower casing. The hinge device includes a first block and a second block for linking with the first block. A latching post is formed on the first block. The second block forms a plurality of engaging plate. Each engaging plate defines a slot through a lower edge thereof for latching with the latching post. Each slot has a receiving hole for receiving the latching post and a guiding hole for guiding the latching post. The guiding hole is generally wider toward the lower edge of each engaging plate. The narrowest portion of the guiding hole is slightly narrower than the latching post to firmly retain the latching post in the receiving hole.

11 Claims, 4 Drawing Sheets

PACKAGING CASE

BACKGROUND OF THE INVENTION

1. Field of the Invention

This invention relates to a packaging case, particularly to a packaging case has an upper and lower cases reliably linking together.

2. Background of the Invention

Packaging cases for swimming goggles are designed in light of the material thereof. For instance, the package packaging cases formed of soft material are shaped of bag, which has an opening and a cord around the opening for closing it when a pair of goggles is received therein. While the package packaging cases formed of hard material are shaped of plate, which has upper and lower casings. The upper and lower casings are linked together via a hinge device and can be opened or closed. The hinge device typically includes a projection axle and a hole, which are formed respectively on the upper and lower casings for linking therebetween.

However, the projection axle is inconvenient to be engaged into the hole during assembly. Moreover, the connection between the axle and the hole is loose such that the upper casing rotates about the projection axle unreliably when the packaging case is opened.

BRIEF DESCRIPTION OF THE INVENTION

1. Objective of the Invention

The objective of this invention is to provide a packaging case for swimming goggles, which is easily assembled.

Another objective of this invention is to provide a packaging case for swimming goggles, which is opened and closed reliably and easily.

2. Characteristics of the Invention

A packaging case for swimming goggles includes an upper casing, a lower casing, and a hinge device for linking the upper casing with the lower casing.

The hinge device includes a first block and a second block for linking with the first block. The second block forms a plurality of receiving plates arrayed in a line and parallel to each other. The first block has a plurality of engaging plates arrayed in a line and parallel to each other for cooperating with the receiving plates of the second block.

A latching post is formed through and substantially perpendicular to the receiving plates of the first block. Each engaging plate of the first block defines a slot through a lower edge thereof for latching with the latching post. Each slot has a receiving hole for receiving the latching post and a guiding hole for guiding the latching post. The guiding hole is generally wider toward the lower edge of each engaging plate. The narrowest portion of the guiding hole is slightly narrower than the latching post to firmly retain the latching post in the receiving hole.

BRIEF DESCRIPTION OF DRAWINGS

The drawings of preferred embodiments of this invention are described in following details to enable better understanding.

DETAILED DESCRIPTION OF PREFERRED EMBODIMENTS

Figure 1:
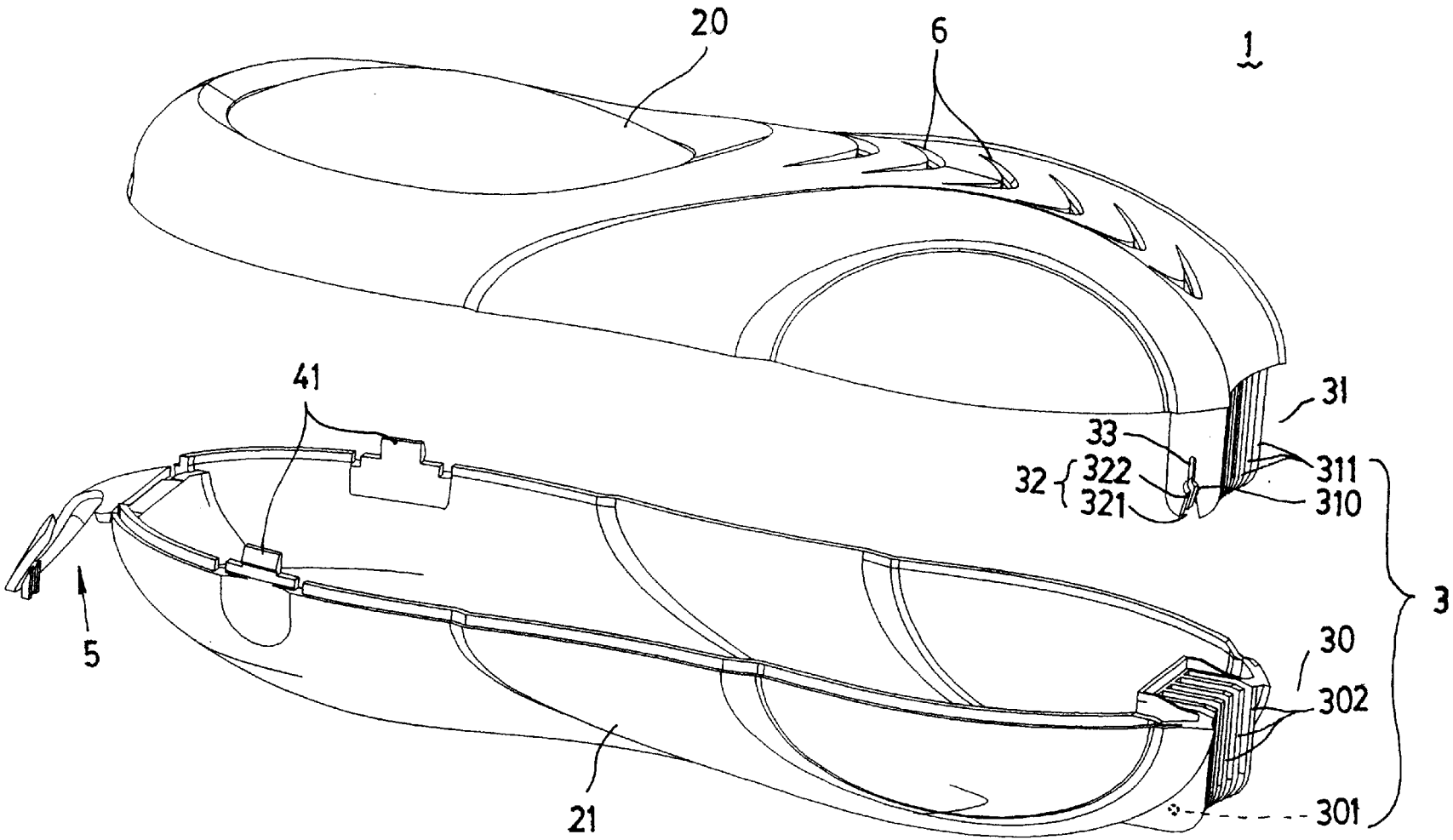
FIG. 1 is a perspective, disassembled view of a packaging case of this invention.

As shown in FIG. 1, this invention of the packaging case 1 comprises a plate-like upper casing 20, a plate-like lower casing 21, and a hinge device 3 for linking the upper casing 20 with the lower casing 21.

The lower casing 21 forms a peripheral edge slightly projecting for reliably engaging with an edge of the upper casing 20. A plurality of holes 6 is distributed on outer faces of the upper casing 20 and the lower casing 21 for ventilation and drain. A pair of protrusions 41 respectively projects from opposite sides of the lower casing 21 and faces to each other. A pair of clamps 40 (shown in FIG. 4) is respectively formed on opposite sides of the upper casing 20 for locking the protrusions 41. A hook 5 is provided at an end of the lower casing 21.

The hinge device 3 includes a first block 31 and a substantially rectangular second block 30 for linking with the first block 31.

The second block 30 is integrally formed on an end of the lower casing 21 and forms a plurality of receiving plates 302 arrayed in a line and parallel to each other at one end of inner side of the lower casing 21. A latching post 301 is integrally formed through and substantially perpendicular to the receiving plates 302.

The first block 31 is integrally formed on an end of the upper casing 20 and has a plurality of engaging plates 311 arrayed in a line and parallel to each other at one end of inner side of the upper casing 20 for cooperating with the receiving plates 302. Each engaging plate 311 has an arcuate side pointing away from the upper casing 20 and defines a slot 32 through a lower edge thereof for latching with the latching post 301 of the second block 30. Each slot 32 has a receiving hole 310 for receiving the latching post 301 and a guiding hole 321 for guiding the latching post 301. The guiding hole 321 is generally wider toward the lower edge of each engaging plate 311. A narrowest portion 322 of the guiding hole 321 is slightly narrower than the latching post 301 to firmly retain the latching post 301 in the receiving hole 310. A longitudinal groove 33 is defined in the engaging plate 311 and communicates with the slot 32 thereby enhancing the resiliency of the receiving hole 310.

Figure 2:
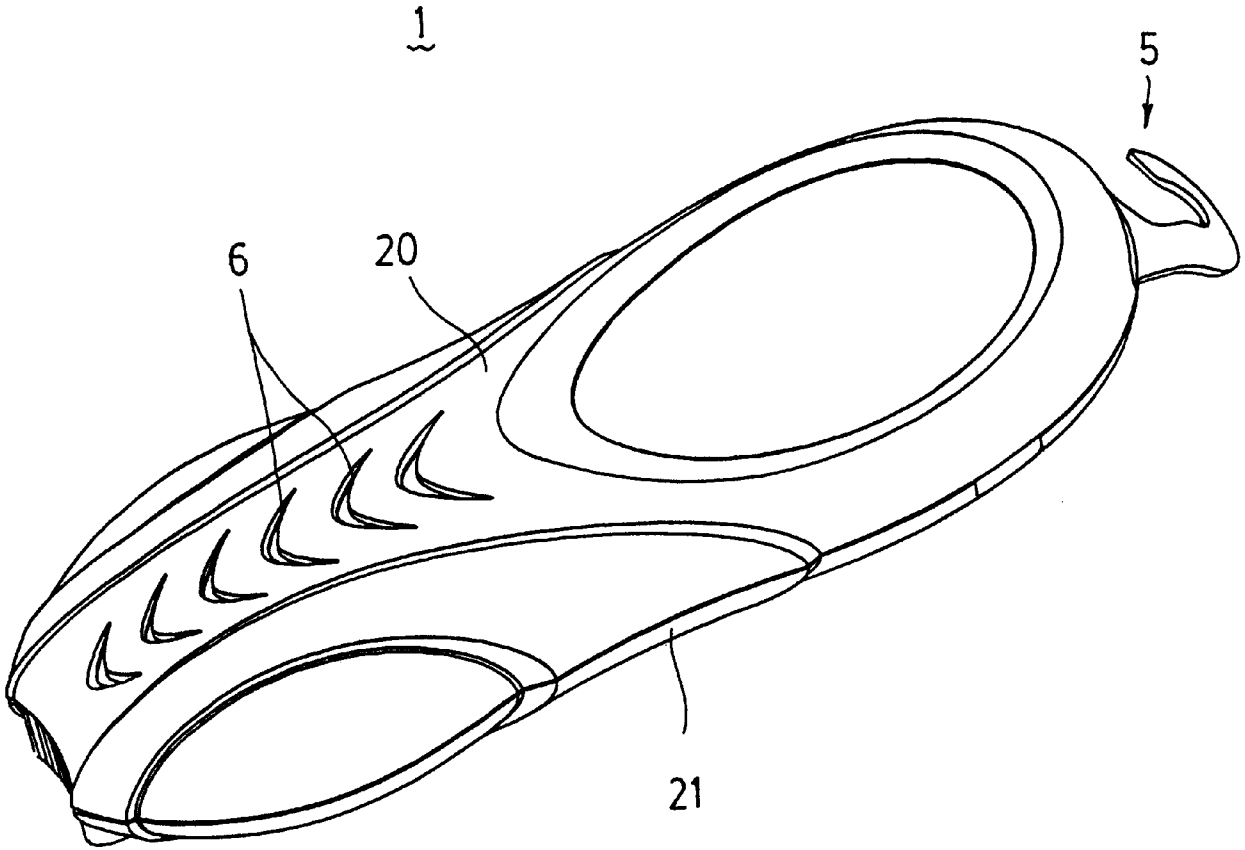
FIG. 2 is a perspective, assembled view of the packaging case of this invention, wherein the packaging case is closed.
Figure 3:
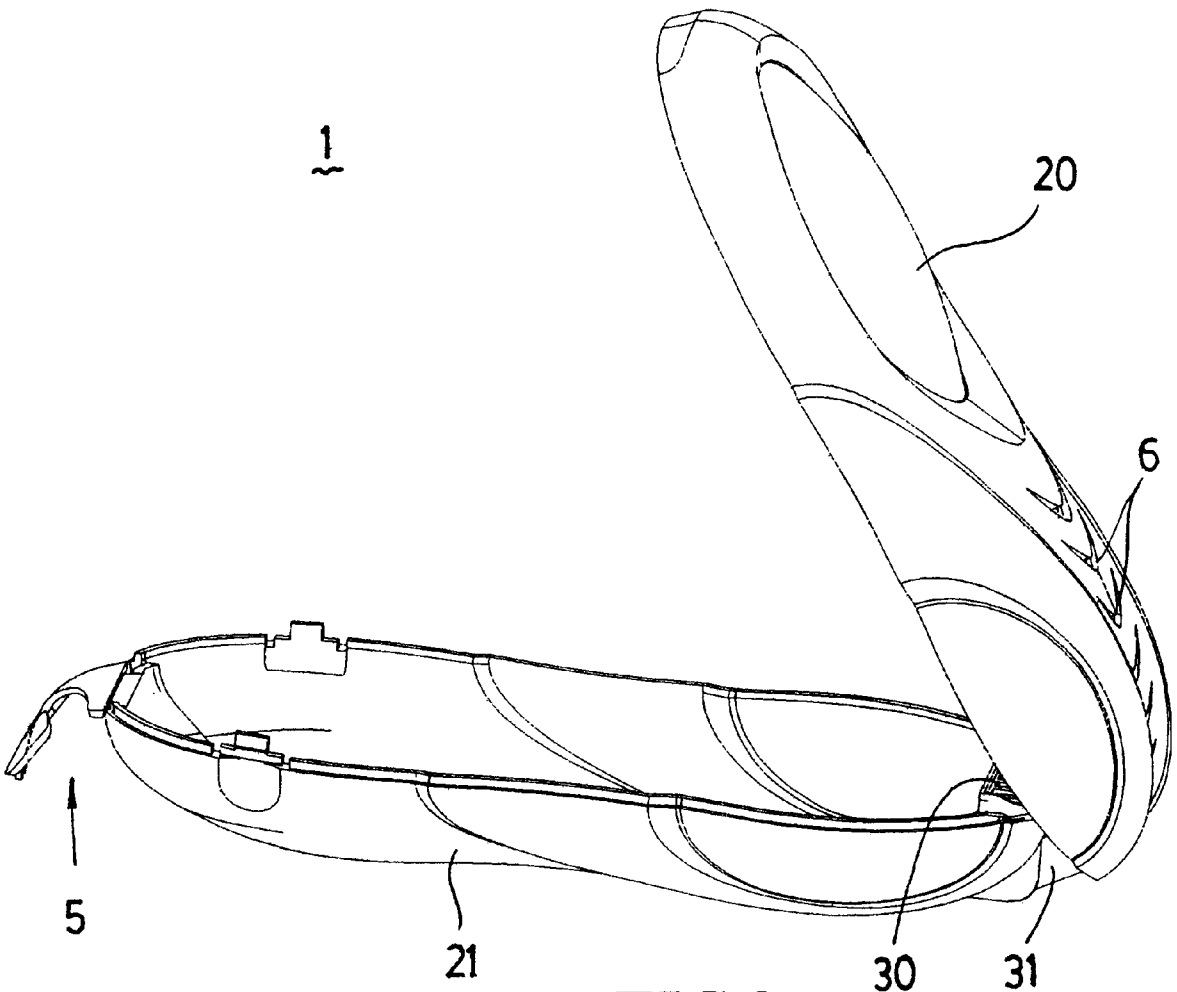
FIG. 3 is an assembled view of the packaging case of this invention, wherein the packaging case is opened.
Figure 4:
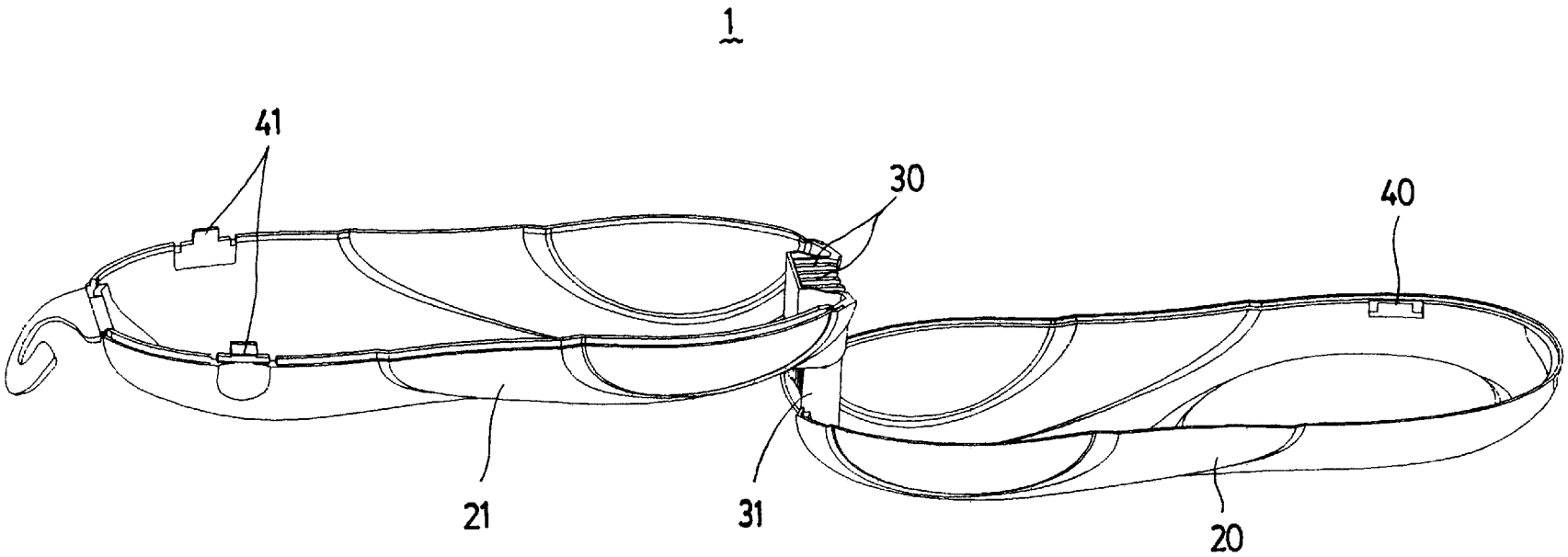
FIG. 4 is an assembled view of the packaging case of this invention, wherein the packaging case is fully opened.

In assembly, as shown in FIGS. 2, 3 and 4, the first block 31 engages with the second block 30 thereby linking the upper casing 20 with the lower casing 21. The engaging plates 311 of the first block 31 are received between the receiving plates 302 of the second block 30. The latching post 301 of the second block 30 latches with the receiving holes 310 of the fist block 31.

The upper casing 20 and the lower casing 21 defines a space therebetween for receiving a swimming goggles when the packaging case 1 is closed. The clamps 40 of the upper casing 20 are respectively locked the, protrusions 41 of the lower casing 21, such that the peripheral edge of the lower casing 21 reliably fits to the edge of the upper casing 20.

As evidenced in the above description, this invention is capable of achieving its anticipated objective. However, the above description covers only the preferred embodiment of this invention. All modifications and variations deriving from this invention shall be included in the claim of this patent.

What is claimed is:

1. A packaging case comprising:

an upper casing, a lower casing, and a hinge device for linking the upper casing with the lower casing;

wherein the hinge device includes a first block and a second block for linking with the first block, the second block being formed on the lower casing and having a plurality of receiving plates and a latching post integrally formed through the receiving plates, the first block being formed on the upper casing and having a plurality of engaging plates for cooperating with the receiving plates of the second block, each engaging plate of the first block defining a slot through a lower edge thereof, the slot has a receiving hole for receiving the latching post, a guiding hole is generally wider toward the lower edge of each engaging plate for guiding the latching post, and wherein the narrowest portion of the guiding hole is slightly narrower than the latching post to firmly retain the latching post in the receiving hole.

2. The packaging case as claimed in claim 1, wherein a longitudinal groove is defined in each engaging plate and communicates with the slot thereby enhancing the resiliency of the receiving hole.

3. The packaging case as claimed in claim 1, wherein the plurality of receiving plates are arrayed in a line and parallel to each other at one end of inner side of the lower casing.

4. The packaging case as claimed in claim 1, wherein the plurality of engaging plates are arrayed in a line and parallel to each other at one end of inner side of the upper casing for cooperating with the receiving plates.

5. The packaging case as claimed in claim 1, wherein a pair of protrusions respectively projects from opposite sides of the lower casing and faces to each other, and a pair of clamps is respectively formed on opposite sides of the upper casing for locking the protrusions.

6. The packaging case as claimed in claim 1, wherein a hook is provided at an end of the lower casing.

7. The packaging case as claimed in claim 6, wherein a plurality of openings is distributed on outer faces of the upper casing and the lower casing for ventilation and drain.

8. A packaging case comprising:

an upper casing integrally forming a first block on an end thereof, the first block having a plurality of engaging plates arrayed in a line and parallel to each other, each engaging plate defining a slot with a receiving hole at an edge thereof, a lower casing integrally forming a second block on an end thereof, the second block having a plurality of receiving plates arrayed in a line and parallel to each other for cooperating with the engaging plates, a latching post being integrally formed through the receiving plates latching with the receiving hole of the slot of the first block, wherein a guiding hole is generally wider toward the lower edge of the engaging plate for guiding the latching post, wherein the narrowest portion of the guiding hole is slightly narrower than the latching post to firmly retain the latching post in the receiving hole, and wherein a longitudinal groove is defined in each engaging plate and communicates with the slot thereby enhancing the resiliency of the receiving hole.

9. The packaging case as claimed in claim 8, wherein a pair of protrusions respectively projects from opposite sides of the lower casing, and wherein a pair of clamps is respectively formed on opposite sides of the upper casing for locking the protrusions.

10. The packaging case as claimed in claim 8, wherein a hook is provided at an end of the lower casing.

11. The packaging case as claimed in claim 8, wherein a plurality of openings is distributed on outer faces of the upper casing and the lower casing for ventilation and drain.

* * * * *